US005934122A

United States Patent [19]

Edwards et al.

[11] Patent Number: 5,934,122

[45] Date of Patent: Aug. 10, 1999

[54] LOCKING COVER FOR DEAD BOLT ACTUATORS

[75] Inventors: Titus M. Edwards; Tom Leaf, both of Ft. Lauderdale, Fla.

[73] Assignee: Sure-Wood Lock, Inc., Fla.

[21] Appl. No.: 09/082,132

[22] Filed: May 20, 1998

[51] Int. Cl.[6] ..... E05B 13/00

[52] U.S. Cl. ..... 70/416; 70/224; 70/163

[58] Field of Search ..... 70/416, 381, 149, 70/218–224, 472, 158, 163–173

[56] References Cited

U.S. PATENT DOCUMENTS

| | | | |
|---|---|---|---|
| 1,842,182 | 1/1932 | Lindsey | 70/222 |
| 2,497,329 | 2/1950 | Smith et al. | 70/223 X |
| 2,729,090 | 1/1956 | Floraday | 70/223 |
| 3,426,932 | 2/1969 | Rouse | 70/223 X |
| 3,796,074 | 3/1974 | Vik | 70/223 X |
| 3,922,896 | 12/1975 | Kagoura | 70/223 |
| 4,055,361 | 10/1977 | Moses | 70/416 |
| 4,064,721 | 12/1977 | Morgan | 70/416 |
| 4,362,035 | 12/1982 | Vitale | 70/416 X |
| 4,947,663 | 8/1990 | Yeager | 70/416 |
| 5,003,803 | 4/1991 | Richards | 70/416 |
| 5,052,202 | 10/1991 | Murphy | 70/416 X |
| 5,421,074 | 6/1995 | Moore | 70/416 X |
| 5,809,815 | 9/1998 | Lee | 70/149 X |

*Primary Examiner*—Suzanne Dino Barrett
*Attorney, Agent, or Firm*—J. Sanchelima

[57] ABSTRACT

A locking cover for a dead bolt lock assembly that permits a user to put it in one of three positions: neutral, locked and unlocked. The cover in the neutral position permits the operation of the bolt lock assembly normally. The other positions limit the rotational travel of the actuating shaft to one quarter of a turn. The actuating shaft is rotated by turning the locking cover that includes a central tubular cylinder that for selective engagement with the actuating shaft. A pin mounted on the interior of the cover is receivable within one of three holes on an annular base plate that limit the rotation of the actuating shaft. An annular base plate with a through opening includes a perpendicularly disposed tubular member that has an inwardly extending flange that together with an annular plug and a retainer ring keep in place a spring member biasing the cover towards the annular base plate assembly.

6 Claims, 3 Drawing Sheets

LOCKING COVER FOR DEAD BOLT ACTUATORS

BACKGROUND OF THE INVENTION

1. Field of the Invention

The present invention relates to a locking cover assembly for dead bolt locks with actuator shafts, and more particularly, to the type that is used in conjunction with a closure member.

2. Description of the Related Art

A conventional dead bolt lock assembly includes an actuator shaft with an end extending towards the protected interior. A cylindrical or cover assembly is typically mounted at the end of the actuator shaft to permit a user to rotate it and thus cause the dead bolt to protrude or come within the closure member (usually a door). The conventional dead bolt assembly has an actuator shaft that has a rectangular cross-section, in most cases. The present invention permits a user to selectively limit the rotation of the actuator shaft by cooperatively positioning stopper members in the cover in one of three predetermined positions. In this manner, an occupant of the protected premises may selectively position the cover to (a) neutral and the dead bolt assembly operates normally; (b) limit the rotation of the actuator shaft to prevent the dead bolt from protruding out; and (c) limit the rotation of the actuator shaft to prevent the dead bolt from retracting inside the closure member (locking the door). Under (b) and (c) a user outside the protected premises would not be able to lock the door (if in position b) or unlock (if in position c) the closure member.

The applicant believes that the closest reference corresponds to U.S. Pat. No. 5,313,812 issued to Eklund for a door lock security system. However, it differs from the present invention because it is a voluminous and complicated device that needs to be mechanically coupled with handle 46 which comes in a variety of designs, including round design (for which it will not operate). Also, off-centered portion 14 requires a structural modification of the closure member with the consequent inconvenience Finally, and more important, the patented device has a bulky "immobilizer" handle 46 whereas the present invention, as discussed above, permits a user to readily select one of three positions in a minimum of space.

Another relevant reference is U.S. Pat. No. 5,515,704 issued to Van Nguyen on May 14, 1996 for a security lock for a dead bolt lock assembly. As in the previous patent, the objective is to immobilize handle 36 requiring a mechanical structure to be attached to the closure member.

The present invention is an improvement over pending and allowed patent applicant Ser. No. 08/731,327 filed on Oct. 15, 1996 and assigned to a common assignee. It differs in that it does not require an annular threaded flange member and the spring is smaller in diameter thusmanufacturing and assembly is substantially simpler with less components.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a locking cover assembly that permits a user to selectively limit the rotational movement of an actuating shaft of a dead bolt lock mounted on a closure member.

It is another object of this invention to provide a locking cover assembly that permits a user to lock a closure from inside of a dwelling even though a second party actuating the locking assembly with a key from the opposite side of the closure member would not be able to activate it.

It is still another object of the present invention to provide a locking cover assembly that is easy to install and manipulate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
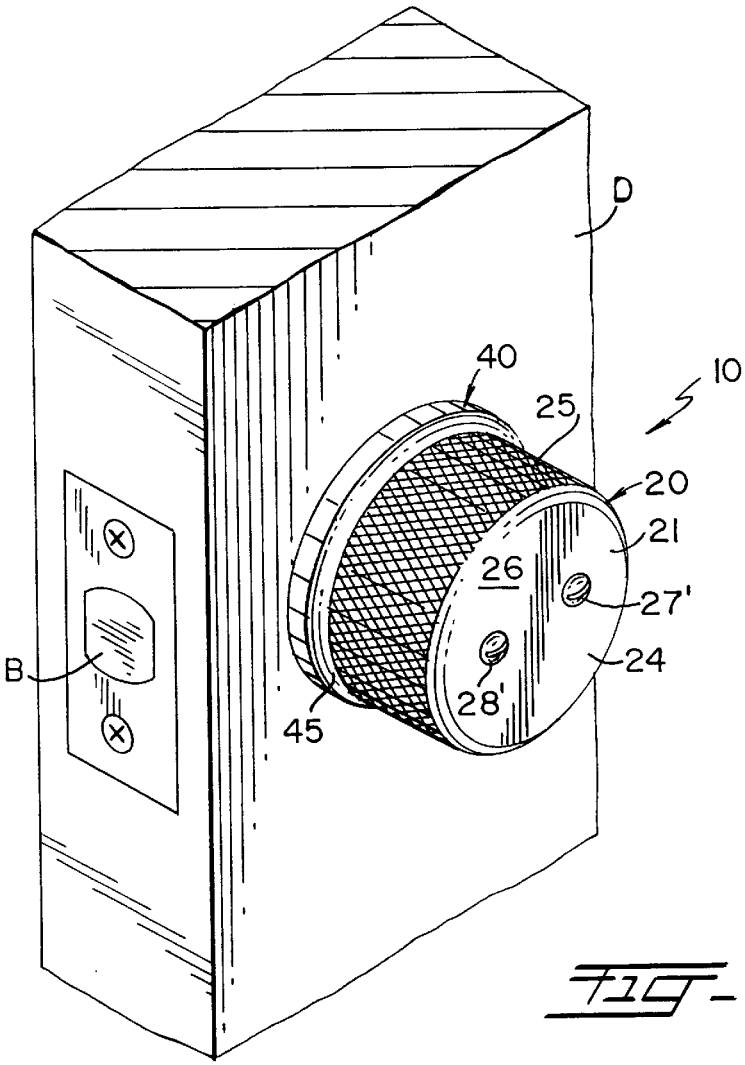
FIG. 1 is an isometric view of the present invention mounted on the interior wall of a closure member such as a door.

Referring now to the drawings, where the present invention is generally referred to with numeral 10, it can be observed that it basically includes cover assembly 20 mounted to annular base plate assembly 40 that in turn is mounted to the interior or protected wall of closure member D, which is typically a door.

Figure 3:
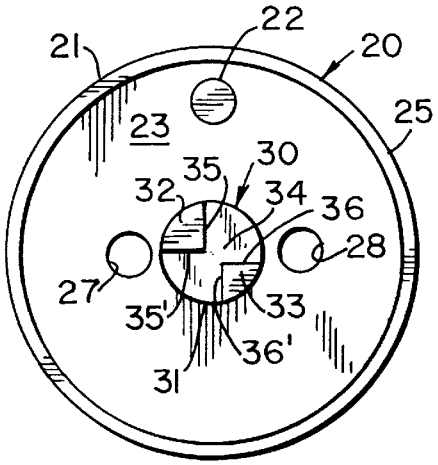
FIG. 3 is a bottom view of the cover assembly.
Figure 5:
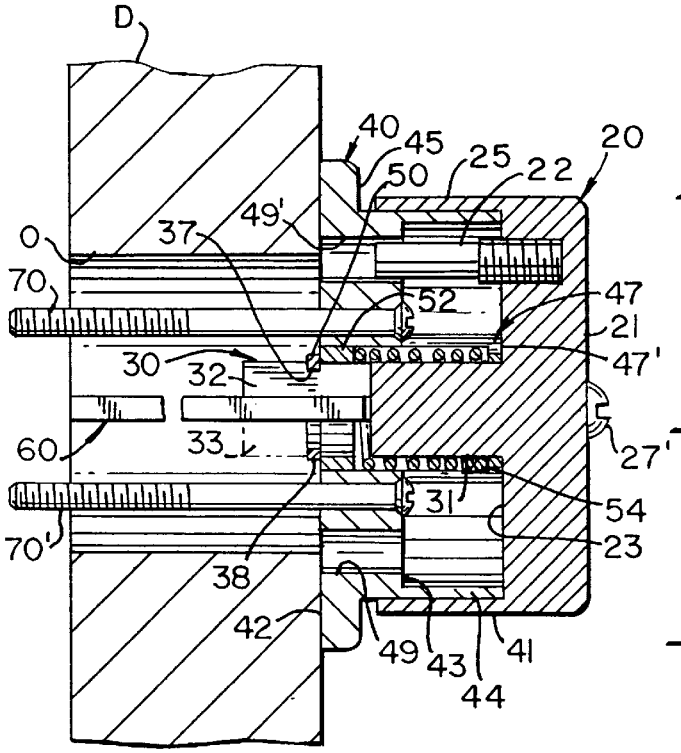
FIG. 5 is a side cross-sectional view of this invention, similar to the previous figure showing the cover assembly rotated 90 degrees with respect to the position shown in FIG. 4 and with the locking pin in the locked position. The cover member is released and the spring is shown in its distended position.

Cover assembly 20, in the preferred embodiment, includes cover member 21 with keyed stopper cylindrical assembly 30 and locking pin 22 that are rigidly and perpendicularly mounted to inner surface 23 of cover member 21, as illustrated in FIGS. 3; 4; 5 and 8. Cover member 21 has wall 24 and peripheral wall or skirt 25 that extends from the edge of wall 24. Wall 24 has inner surface 23 and outer surface 26. Peripheral wall or skirt 25 has a coarse (or diamond cut) surface that enhances a user's grip. Cover member 21 also includes through threaded openings 27 and 28 to cooperatively receive screw members 27' and 28', respectively, to block the access to the internal mechanism. Cover assembly 20 is removably mounted to annular base plate assembly 40 and kept in place by retaining ring 50 and annular plug 52, as best seen in FIG. 5.

Figure 4:
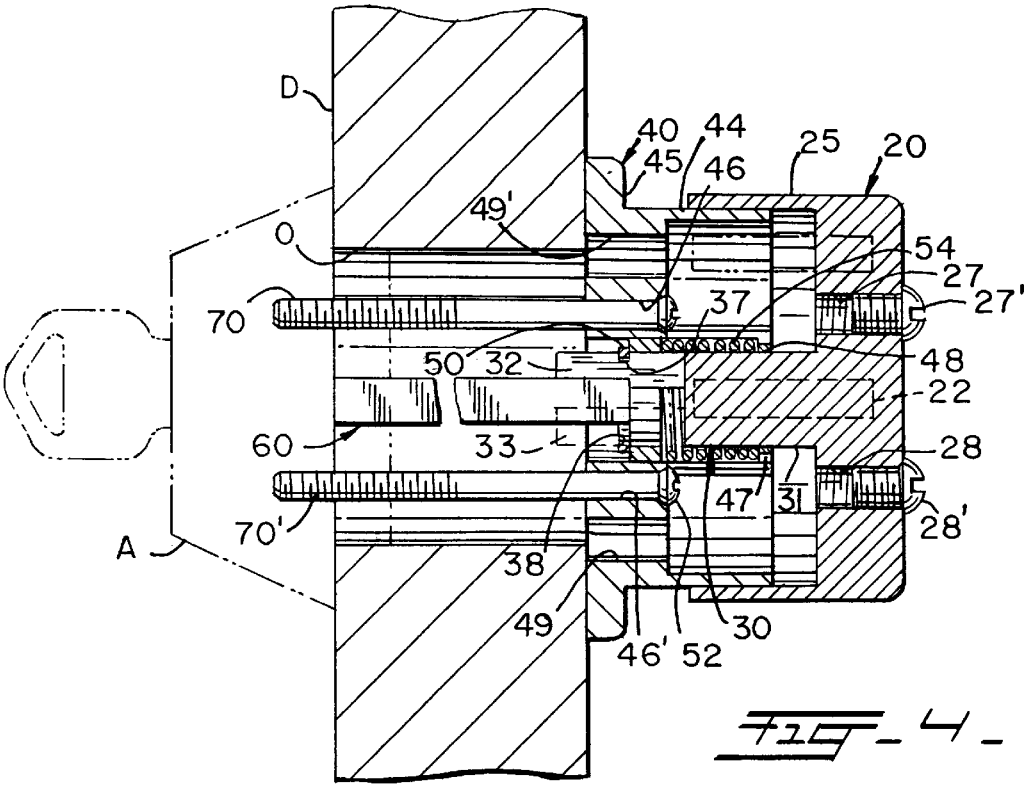
FIG. 4 is a side cross-sectional view of the present invention mounted on door D, showing the cover member pulled out by a user, the spring compressed and the locking pin removed from its neutral position as shown in phantom.
Figure 8:
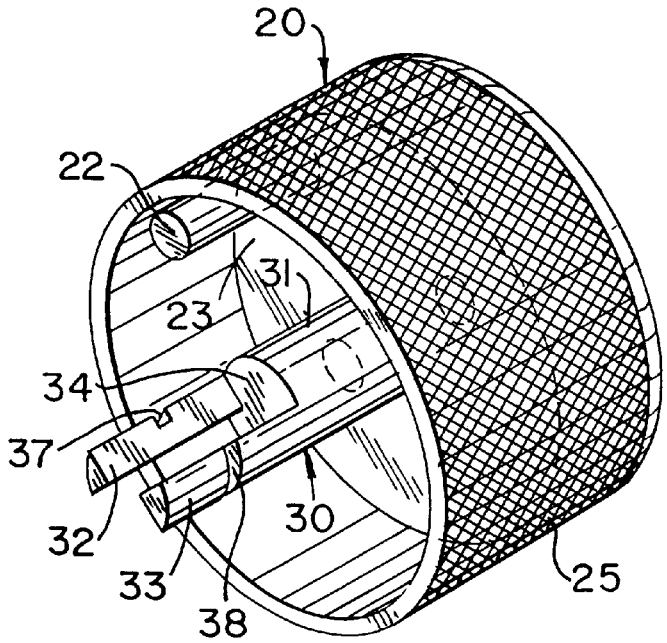
FIG. 8 is an isometric view from the bottom of the cover assembly showing the cylindrical member and the locking pin.

Keyed stopper cylindrical assembly 30, as best seen in FIGS. 3 and 8, is centrally disposed within cover assembly 20. Cylindrical assembly 30, in the preferred embodiment, has cylinder 31 and elongated stopper members 32 and 33 perpendicularly extending from surface 34, as shown in FIGS. 3 and 8. Elongated members 32 and 33 include two opposite stopper edges 35; 35' and 36; 36', respectively, that are radially inwardly disposed. Elongated members 32 and 33 includes slots 37 and 38, respectively. Slots 37 and 38 are located in a substantial middle position of the outer surface of elongated members 32 and 33, respectively. Slots 37 and 38 are designed to cooperatively receive retaining ring 50 therein, as shown in FIGS. 4 and 5. Elongated members 32 and 33 are separated a sufficient distance to house actuating shaft member 60 so that cover assembly 20 can be selectively rotated one quarter of a turn without causing actuating shaft member 60 to rotate. If cover assembly 20 is rotated another quarter of a turn in the same direction then shaft 60 is also rotated. In this manner, actuating shaft member 60 causes dead bolt B to either protrude out or collect itself within closure member D.

Figure 2:
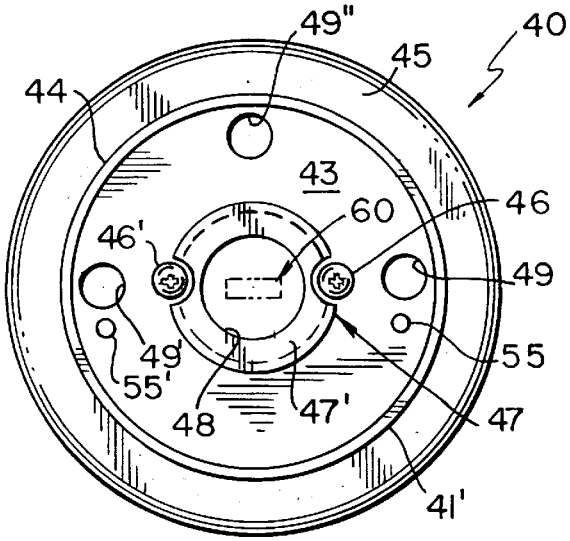
FIG. 2 is a top view of the annular base plate assembly used in one of the preferred embodiments of this invention.
Figure 9:
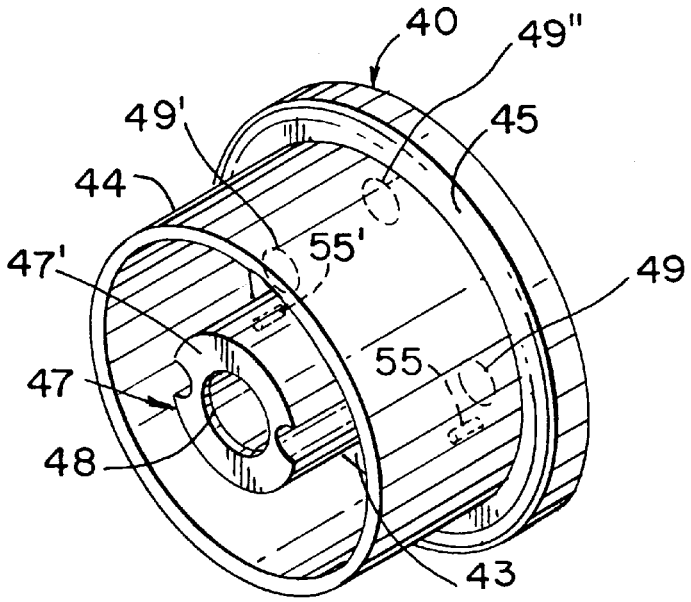
FIG. 9 is an isometric view from the top of the annular base plate assembly.

In FIGS. 2; 4; 5 and 9 annular base plate assembly 40 is shown. Annular base plate assembly 40 is rigidly mounted to the peripheral edge of through opening O of closure member D. Annular base plate assembly 40, in the preferred embodiment, includes cylindrical case member 41 with bottom wall 42, upper wall 43 and peripheral wall 44. Bottom wall 42 rests against interior wall of closure member D adjacent to opening O. Peripheral wall 44 perpendicularly and outwardly extends from annular flange 45. Annular base plate assembly 40 also includes through openings 46 and 46' that are designed to receive fastening members 70 and 70' through. This permits a user to fasten annular base plate assembly 40 and cover assembly 20 to the interior wall of closure member D adjacent to opening O. Cylindrical case member 41 has centrally and coaxially disposed tubular member 47 that is rigidly and perpendicularly mounted to upper wall 43, as best seen in FIGS. 4 and 5. Flange 47' extends inwardly from the outer end of tubular member 47, in the preferred embodiment, defining opening 48 through which cylindrical assembly 30 is inserted. As shown in FIGS. 2 and 9, upper wall 43 has holes 49; 49' and 49" which are designed to cooperatively and selectively receive pin member 22 of cover assembly 20 in three positions. Hole 49 corresponds to the locked position, hole 49' to the unlocked position and 49" to the neutral position. These three positions are selected by a user's rotational movement of cover assembly 20.

Spring member 54 is housed between tubular member 47 and cylinder 31 of cylindrical assembly 30. Spring member 54 is designed to bias cover assembly 20 against annular base plate assembly 40. This spring bias will ensure that locking pin 22 will be lodged at one of holes 49; 49' or 49", and thus immobilizing cover member 21 and actuating shaft member 60. Annular plug member 52 is mounted between tubular member 47 and elongated stop members 32 and 33. Annular plug member 52 is prevented from sliding out by retaining ring 50 and both keep spring member 54 housed inside tubular member 47.

Guide members 55 and 55' end the angular travel of locking pin member 22. Guide members 55 and 55' are perpendicularly and rigidly mounted on upper wall 43 of annular base plate assembly 40, as illustrated in FIGS. 2; 4 and 5.

Locking cover assembly 10 is mounted on closure member D in alignment with keyhole cylinder assembly A and interconnected through opening O. As mentioned above, cover assembly 10 can be easily mounted by inserting fastening members 70 and 70', such as screws, through openings 27 and 28 of cover member 21, respectively, and through openings 46 and 46' located on upper wall 43 of annular base plate assembly 40 and finally through keyhole cylinder assembly A conventionally installed into closure member D. Then, through openings 27 and 28 are covered with screw members 27' and 28', respectively, to block the access of a wrongdoer to fastening members 70 and 70'.

Figure 6A:
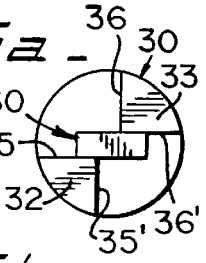
FIG. 6*a* represents the locked position for actuating shaft member as determined by the position of the keyed stopper cylindrical assembly.
Figure 6B:
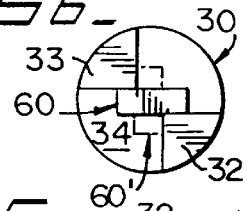
FIG. 6*b* represents the neutral position for actuating shaft member.
Figure 6C:
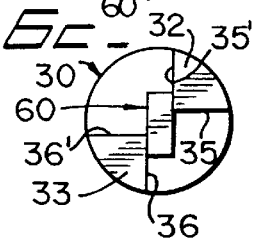
FIG. 6*c* represents the unlocked position for actuating shaft member.

In FIGS. 6*a;* 6*b* and 6*c,* elongated stop members 32 and 33 and actuating shaft member 60 are shown in the locked, neutral and unlocked positions from top to bottom, respectively, in this preferred embodiment. In the locked (FIG. 6*a*) position, a user with a key would attempt to cause shaft 60 to rotate counterclockwise but shaft 60 will be obstructed by stopper edges 35 and 36'. In the neutral position (FIG. 6*b*) shaft 60 can be rotated in both directions (60 and 60') by a user with a key and therefore the dead bolt mechanism will behave as if cover 10 were not there. Lastly, in the unlock position (FIG. 6*c*) shaft 60 is kept at the end of its counterclockwise travel by stopper edges 35' and 36'.

Figure 7:
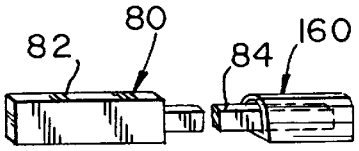
FIG. 7 is an isometric partial view of an adapter to be used on non-rectangular shafts found in some dead bolt lock assemblies.

In FIG. 7, adapter 80 includes actuating shaft member 82 rigidly mounted to elongated connecting member 84. Actuating shaft member 82 has a rectangular cross-section that is compatible with keyed stopper cylindrical assembly 30, as previously described. Adapter 80 is used with dead bolt assemblies that have shaft 160 with different cross-section, depending on the model of keyhole cylinder assembly A.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A locking cover for a dead bolt lock assembly mounted inside a through opening cooperatively positioned adjacent to the edge of a closure member having external and interior walls and said dead bolt lock assembly includes an actuating shaft member that is connected to, and driven by, a key cylinder assembly that causes the actuating shaft member to selectively rotate thereby causing a dead bolt member to protrude and retract from an opening, and said actuating shaft member, being also directly actionable, comprising:

A) an annular base plate assembly having a bottom wall, adapted to be mounted to said interior wall and peripherally over said through opening and said annular base plate assembly includes a cylindrical case member extending perpendicular to said bottom wall and further including a tubular member with first and second ends, said first end being centrally mounted on said bottom wall and said second end further including an inwardly extending flange;

B) cover means having an outer wall with a peripheral skirt and a centrally disposed keyed stopper cylinder assembly coaxially aligned with said peripheral skirt, and said keyed stopper assembly including a cylinder member mounted to the inner surface of said outer wall at a position that permits said actuating shaft member to go longitudinally into said keyed stopper assembly, and said keyed stopper assembly including two opposite elongated stopper members that extend axially from said central cylinder member and separated a sufficient distance to permit said actuating shaft member between said elongated members so that said cover means is selectively rotated one quarter of a turn without causing said activating shaft member to rotate and the next quarter of a turn causes said dead bolt member to either protrude out or collect within said opening, and said cover means further includes an off centered pin mounted on said inner surface of said outer wall and said pin being cooperatively receivable within a plurality of holes in said annular base plate assembly to prevent said cover means from rotating when said cover means is brought against said annular base plate assembly; and C) spring means for biasing said cover means against said annular base plate assembly and said spring means being housed between said tubular member and said keyed stopper assembly.

2. The locking cover set forth in claim 1 wherein said spring means includes a spring member and an annular plug member traveling said keyed stopper assembly, and said keyed stopper assembly including a peripheral slot located on said elongated stopper members and a retainer ring cooperatively receivable within said peripheral slot so that said annular plug member keeps said spring member in compressed state.

3. The locking cover set forth in claim 2 whereas said annular base plate assembly includes an upper annular wall parallel and spaced apart from said bottom wall and including two holes through said base plate assembly, and further including fastening means that cooperatively pass through said two holes for firmly engaging said annular base plate assembly against said interior wall.

4. The locking cover set forth in claim 3 wherein said outer wall includes cooperatively positioned openings to permit a user to access said fastening means without removing said cover means.

5. The locking cover set forth in claim 4 wherein said upper annular wall includes guiding means for limiting the travel of said pin and facilitating locating said pin receivable holes.

6. The locking cover set forth in claim 5 wherein said elongated stopper members have a cross-section that includes two substantially flat sides that extend radially inwardly and with a cooperative separation to permit the rotation of said cover means one quarter of a turn without causing said actuating shaft member to rotate.

* * * * *